US005347878A

United States Patent [19]

Suovaniemi

[11] Patent Number: 5,347,878

[45] Date of Patent: Sep. 20, 1994

[54] PIPETTE WITH LOCKING ADJUSTMENT AND METHOD FOR USING THE SAME

[75] Inventor: Osmo Suovaniemi, Helsinki, Finland

[73] Assignee: Biohit OY, Helsinki, Finland

[21] Appl. No.: 956,897

[22] PCT Filed: May 3, 1991

[86] PCT No.: PCT/FI91/00135

§ 371 Date: Dec. 30, 1992

§ 102(e) Date: Dec. 30, 1992

[87] PCT Pub. No.: WO91/16976

PCT Pub. Date: Nov. 14, 1991

[30] Foreign Application Priority Data

May 4, 1990 [FI] Finland ..... 902269

[51] Int. Cl.[5] ..... B01L 3/02

[52] U.S. Cl. ..... 73/864.18; 222/43; 222/309

[58] Field of Search ..... 222/43, 309; 73/864.13, 73/864.16, 864.18; 422/100

[56] References Cited

U.S. PATENT DOCUMENTS

| | | | |
|---|---|---|---|
| 1,603,888 | 10/1926 | Wilson | 222/43 X |
| 2,771,217 | 11/1956 | Brown et al. | 222/43 |
| 3,343,539 | 9/1967 | Moorhouse | 73/864.18 X |
| 4,081,111 | 3/1978 | Sandow | 222/309 |
| 4,096,751 | 6/1978 | Withers et al. | 73/864.18 |
| 4,165,646 | 8/1979 | Shapiro | 73/864.13 |
| 4,395,921 | 8/1983 | Oppenlander | 222/43 X |
| 4,554,134 | 11/1985 | Tervamäki et al. | 73/864.18 X |

FOREIGN PATENT DOCUMENTS

| | | |
|---|---|---|
| 0153058 | 8/1985 | European Pat. Off. . |
| 57543 | 5/1980 | Finland . |
| 8400119 | 1/1984 | World Int. Prop. O. . |

*Primary Examiner*—Kevin P. Shaver

*Attorney, Agent, or Firm*—Merchant & Gould Smith, Edell, Welter & Schmidt

[57] ABSTRACT

A pipette for emptying liquid and filling with liquid includes a body housing an adjustment mechanism disposed to limit movement of the plunger, the adjustment mechanism being locked with a locking member elastically urged against a notched circle. The notched circle and the adjustment mechanism are rotatable while the locking member is non-rotatably connected to the body. When locked, the locking member rests in the notches of the notched circle, allowing for desired adjustment but preventing inadvertent adjustment of the pipette. A method for locking the pipette is also disclosed.

5 Claims, 2 Drawing Sheets

PIPETTE WITH LOCKING ADJUSTMENT AND METHOD FOR USING THE SAME

Figure 1:
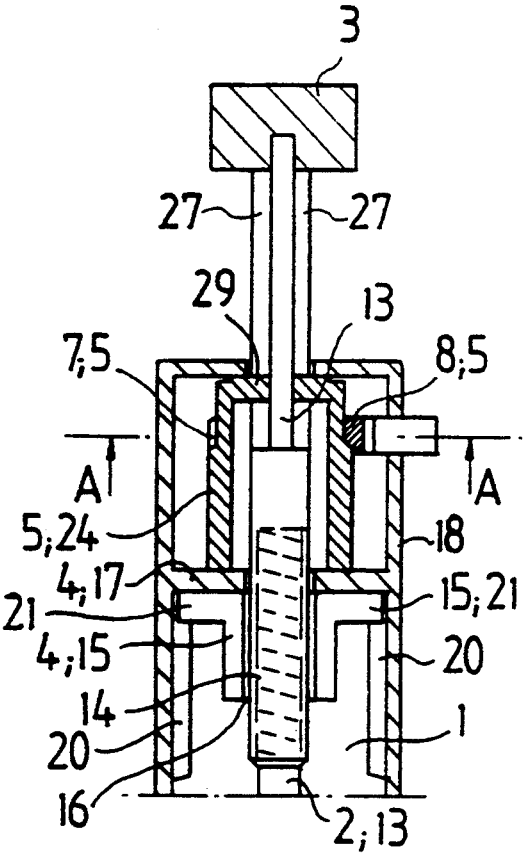

The present invention concerns a procedure for locking the adjustment means of a pipette.

The invention furthermore concerns a pipette.

A pipette is understood to be a device for liquid handling, e.g. for sampling and/or liquid dispensing, based in the first place on use of a plunger. The device may be a single-passage or multiple passage device.

In some of the pipettes, the outer body of the pipette is divided in its longitudinal direction into sections which can be joined by screwing. One of the sections constitutes a graduated adjustment ring for adjusting the dispensing volume of the pipette. The drawback embarrassing this kind of pipettes is awkwardness and inaccuracy of adjustment, that is, the adjustment ring is easily displaced from its setting in connection with tightening. Furthermore, if the body sections have been screwed together with excessive, or inadequate, force, the quantities which the device dispenses may differ from the set dispensing volume. In addition, the above causes have a detrimental effect on the reproducibility of the liquid handling operations which are carried out.

Moreover, a pipette is known in the art of which the adjustment means has been constructed in conjunction with the body. The pipette can be adjusted by rotating the plunger stem, whereby the position relative to the stem of an adjustment sleeve, or equivalent, rotatable relative to the stem changes and the dispensing volume of the pipette is accordingly altered, e.g. when the adjustment sleeve abuts on a limit stop or equivalent. The drawback of this kind of pipette is the change of dispensing volume caused by even minor rotation of the plunger, i.e., when the plunger happens to rotate inadvertently e.g. when the pipette is in use, the dispensing volume is altered.

The object of the present invention is to eliminate the drawbacks mentioned, and to disclose a novel means for liquid handling in which adjustment of the adjustment means is easy to implement, and in which the adjustment means positively and accurately retains the position at which it has been set.

In particular, it is an object of the invention to disclose a novel procedure for locking the adjustment means of a pipette, and a pipette with which sampling and/or liquid dispensing can be carried out accurately and reproducibly.

Regarding the features which are characteristic of the invention, reference is made to the claims section.

The invention is based on the idea that the locking means comprises a notched circle or the like, and a locking member disposed to be locked in any desired notch of said circle, to prevent inadvertent rotation of the adjustment means, and which can when desired be removed from the notch to enable the adjustment means to be rotated, one of the two elements, the notched circle or the locking member, being arranged to rotate along with the adjustment means and the other being connected to the body, to be substantially non-rotatable.

The locking means of the invention, with adjustment means, may be placed in the cylinder volume belonging to the liquid handling device, in conjunction with the plunger, with any part thereof, such as the plunger stem, with the operating means, or in general with any component of the liquid handling means.

In an embodiment of the invention, the notched circle rotates along with the adjustment means and the locking member is non-rotatable relative to the body. In another embodiment of the invention, the notched circle is non-rotatable relative to the body, and the locking member rotates along with the adjustment means.

In an embodiment of the invention, the plunger stem is provided with threads, and the adjustment means comprises an adjustment ring provided with a mating thread, the plunger stem being arranged to rotate in this ring for adjustment of the position in axial direction of the adjustment body and the plunger stem, relative to each other, and a limit stop which has been arranged to delimit the plunger motion when said adjustment ring meets said limit stop. The locking member is in that case arranged to interlock the plunger stem and the adjustment ring non-rotatably.

Furthermore, the notched circle may be rotatable relative to the plunger stem, while the locking member is non-rotatable relative to the plunger stem. Similarly, the notched circle may be disposed to be non-rotatable relative to the plunger stem, in which case the locking member is rotatable relative to the plunger stem. In other words, either one of the notched circle and the locking member may be rotatable relative to the plunger stem, the other component being correspondingly non-rotatable relative to the plunger stem; the part which is rotatable relative to the plunger stem may then be non-rotatable relative to the body of the pipette.—The plunger stem is understood to be a stem fixedly connected with the plunger of the pipette, or a stem-like member connected thereto indirectly, e.g. with the aid of a connecting member, and moving the stem.

The advantage of the invention over liquid handling devices of prior art is that, thanks to the locking means of the invention, the adjustment means cannot be inadvertently displaced from the position in which it has been set.

Further, thanks to the invention;, the locking stations of the locking means can be furnished with graduation corresponding to the dispensing volume, and this facilitates the setting of the adjustment means for the desired volume. Hereby the adjustment can be made accurately and reproducibly.

Figure 3:
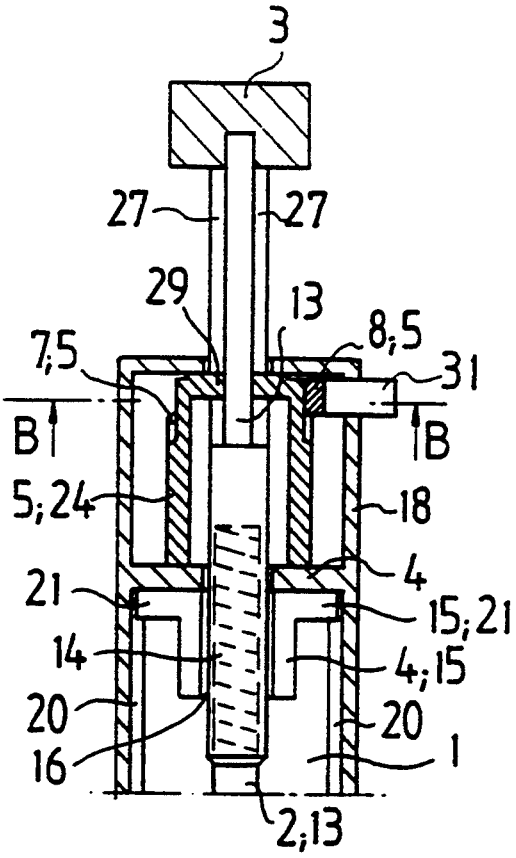
Figure 2:
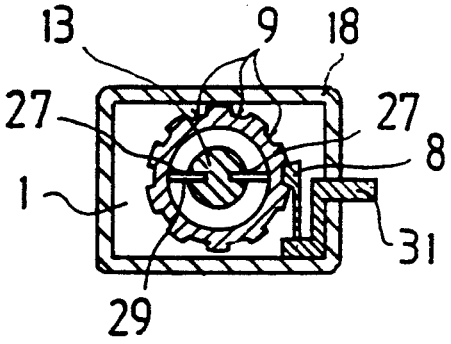
Figure 4:
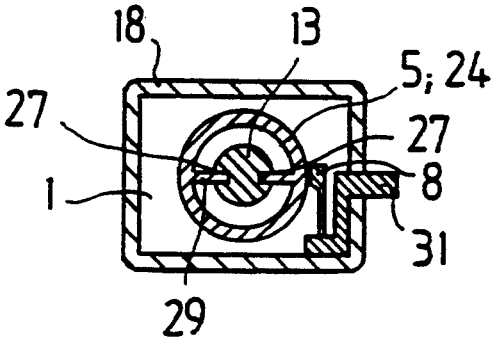
Figure 5:
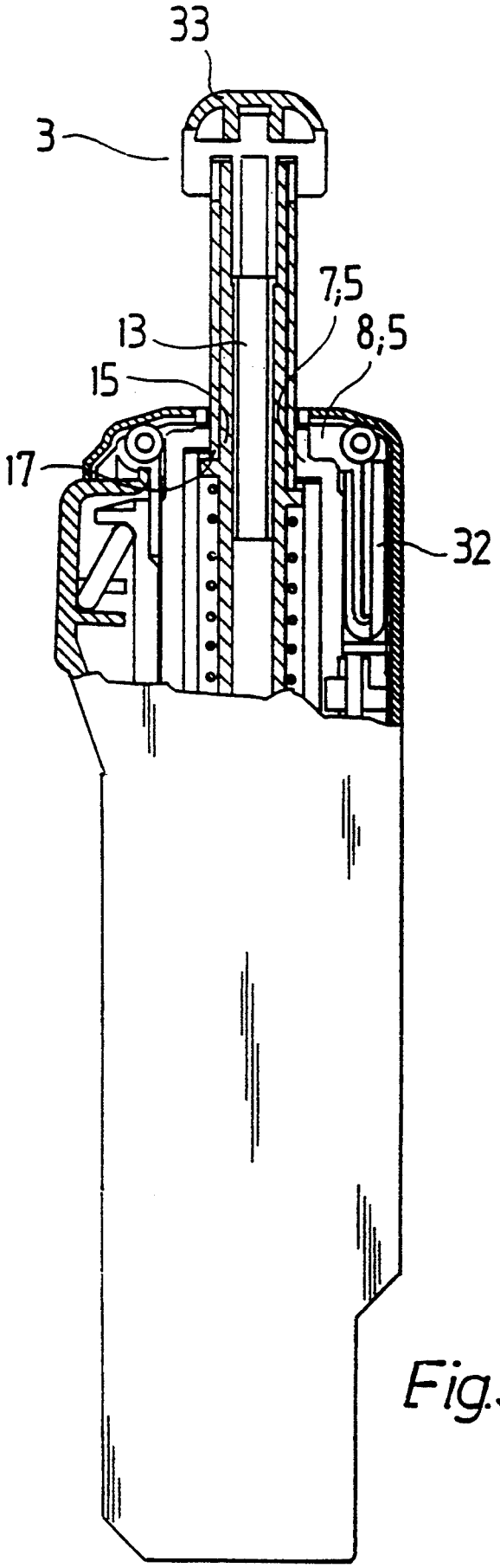

The invention is described in the following in detail with the aid of embodiment examples, referring to the attached drawings, wherein:

FIG. 1 presents a pipette according to the invention, with the volume adjustment means locked, FIG. 2 shows the section A—A of FIG. 1, FIG. 3 presents the pipette of FIG. 1 with the, locking of the volume adjustment means released, FIG. 4 shows the section B—B of FIG. 3, and FIG. 5 presents, sectioned, another pipette according to the invention.

In FIGS. 1 and 3 is depicted the upper part of a pipette according to the invention, in elevational view, and sectioned. The pipette here depicted comprises a cylindrical body 18. On the lower part of the body, a pipette tip (not depicted) can be attached. The body defines within itself a cylinder volume 1, provided with a liquid passage (not depicted). In the cylinder volume a plunger 2 has been fitted to be reciprocatingly movable. To the plunger, that is to the plunger stem 13, is connected an operating means 3, in the depicted embodiment a manual operating means, for moving the plunger.

The pipette further comprises an adjustment means 4, comprising in the embodiment here depicted, a threaded plunger stem 13, an adjustment sleeve 15 provided with a mating thread, the plunger stem being disposed to be rotatable in this sleeve, and a limit stop 17. The adjustment sleeve 15 is further provided with guide members 21 fitted to cooperate with longitudinal guides 20 placed on the inside wall of the cylinder volume 1, so that the adjustment sleeve is substantially non-rotatable along with the plunger stem.

The limit stop 17 consists of a stop face disposed to limit the motion of the plunger in the direction of the limit stop, i.e., in the filling direction as the adjustment sleeve meets the limit stop 17. Alternatively, the limit stop can be arranged to limit the plunger travel in the emptying direction. The limit stop may be of various shapes, and it may for instance be a pin, a shoulder, etc., suitably disposed within the cylinder volume so that it will meet the adjustment ring in the course of the plunger's movement.

Furthermore, the pipette of FIGS. 1 and 3 comprises a locking means 5 according to the invention, arranged to lock the adjustment means in the direction of rotation, i.e., to interlock the plunger stem 13 with the adjustment sleeve 15, to be substantially non-rotatable relative thereto. The locking means has been placed in the part of the cylinder volume delimited by the limit stop 17, that is on the opposite side of the cylinder volume from the plunger.

When the pipette of FIGS. 1 and 3 is adjusted, the locking means 5 is released and the adjustment means 4 is set with the aid of the graduation thereon provided (not visible in the figures) to the desired dispensing volume. The adjustment is made by rotating the plunger stem 13 in the adjustment sleeve 15 so that the part of the plunger stem projecting through the adjustment sleeve into the cylinder volume 1 is shortened or lengthened. The shorter the part of the plunger stem projecting through the adjustment sleeve into the cylinder volume, the greater is the dispensing volume. At the desired dispensing volume the adjustment means 4 is locked to be non-rotatable, with the aid of the locking means 5. The pipette is then ready for use.

When taking a sample or dispensing liquid, the tip of the pipettes is pushed into the liquid in case, and the plunger 2 is pulled up with the aid of the operating means 3. The operating means may be manual, or it may be arranged to be movable in a way known in the art with a power means, such as an electric motor. The plunger moves in the operating direction until the adjustment sleeve meets the limit stop 17 and stops the movement of the plunger. The liquid quantity that has been pushed into the cylinder volume is then consistent with the dispensing volume that has been set. The liquid in the cylinder volume is thereafter dispensed at the desired site by moving the plunger in the emptying direction.

The locking means depicted in FIGS. 1–4 comprises a locking sleeve 24 provided with a notched circle 7, and a locking member 8, fitted to be lockable in any desired notch 9. The locking sleeve 14 encircles the plunger stem 13, and on its outer circumference 7 have been arranged notches 9 (FIG. 3). The plunger stem 13 is provided with two guide grooves 27 running longitudinally to the stem, and the locking sleeve 24 is provided with guides 29 fitted into said grooves, so that the locking sleeve is non-rotatable relative to the plunger stem 13 but freely movable relative to the seem in its longitudinal direction.

The locking member 8 is non-rotatable with the adjustment means 4, i.e., it is mounted on the body 18, and it comprises a handle 31. The locking member is elastically urged against the notched circle, so that when for adjustment of the adjustment means, the plunger is twisted with sufficient force, the locking member rises out of the notch, pushes into the next notch which comes into register, rises out of this latter notch, and so on, until the desired dispensing volume setting has been reached. The turning is stopped when the locking member enters the notch corresponding to the desired dispensing volume, the locking member becoming locked in this notch, i.e., it does not rise out of the notch without plunger-turning force surpassing a given threshold.

The graduation of the adjustment means 4 is advantageously arranged to conform to the locking stations, i.e., to the notches so that a given locking station, or notch, coincides with corresponding pending volume on the graduation. The graduation is advantageously marked in accordance with the dispensing volume increment corresponding to the smallest possible rotation step, this increment suitably corresponding to the distance between two adjacent notches.

In the operating situation, the locking member 8 is locked in a notch 9 for locking the adjustment means 4 (FIGS. 1–3). When the adjustment means is adjusted, the locking member is first removed from the notch by displacing it, with the handle 31, to a position above the notched circle 7 (FIG. 3). The adjustment means can now be turned freely. The locking member 8 has been moved to a position outside the notched circle 7, whereby rotation of the locking sleeve, and thus of the plunger stem, is enabled.

In the embodiment depicted in FIGS. 1–4, the locking sleeve 24 with its notched circle 7 is separate from the plunger stem 13. If desired, the notched circle 7 may be integrally affixed to the plunger stem. Further, in an embodiment of the invention, the circle provided with locking stations may be connected with the adjustment means by mediation of other elements, e.g. of gear transmissions. It is obvious that the circle provided with locking stations, e.g. a notched circle, may equally be arranged to be non-rotatable with the adjustment means, for instance non-rotatably encircling the plunger stem, and the locking member may be arranged to rotate along with the plunger stem.

The reference numerals in the presentation of a pipette in FIG. 5 are mainly consistent with those FIGS. 1–3. In FIG. 5, the locking member 8 is provided with a spring 32 which urges the locking member against the locking notches of the notched circle 7, i.e., of the sleeve-like member. The pipette comprises no specific means for undoing the locking; thanks to the spring the stem 13 can be rotated by the handle 3, and when the turning force surpasses a given threshold the stem is enabled to turn as the locking member rises out of the locking notch, to fall again into the next locking member when the rotation continues. The locking is hereby elastic, preventing inadvertent adjusting or the pipette.

In the embodiment depicted in FIG. 5, the knob of the operating means 3 is provided with a freely turning cap 33, whereby the pipette cannot be inadvertently adjusted when pressure and rotation is applied upon the cap 33.

The embodiment examples are only meant to illustrate the invention, without restricting it in any way whatsoever.

I claim:

1. A pipette comprising: a body, a cylindrical volume formed within the body, the cylindrical volume for permitting liquid passage, a plunger housed at least in part within the cylindrical volume, the body further comprising:

a) means for adjusting the limit movement of the plunger, the adjusting means being operatively connected to the plunger; and b) means for locking the adjusting means to limit the rotation thereof, the locking means including cooperating first and second members, the first member being elastically urged against the second member, the second member in communication with the adjusting means, and the second member being rotatable relative to the body and including means for receiving the first member in a cooperating engagement such that the adjusting means may be selectively locked and unlocked upon rotation of the second member, the locking means additionally includes a handle attached to the first member for moving the first member into and out of contact with the second member.

2. The pipette according to claim 1, wherein the adjustment means is rotatable relative to the body, and the first member is non-rotatable relative to the body.

3. The pipette according to claim 1, wherein the second member includes a circle, and the receiving means for the first member include notches on the circle.

4. The pipette according to claim 3, wherein the first member includes a flange for cooperatingly engaging the notches in the circle.

5. The pipette according to claim 3, wherein the notches correspond to a predetermined volume of liquid.

* * * * *